United States Patent [19]

Plumly

[11] Patent Number: 4,577,264

[45] Date of Patent: Mar. 18, 1986

[54] LIGHTING APPARATUS AND SYSTEM UTILIZING MINIATURE INCANDESCENT LAMPS

[75] Inventor: George W. Plumly, Granbury, Tex.

[73] Assignee: Plumly Lighting Corporation, Fort Worth, Tex.

[21] Appl. No.: 678,669

[22] Filed: Dec. 5, 1984

[51] Int. Cl.[4] ..... F21P 1/00

[52] U.S. Cl. ..... 362/252; 362/150; 362/240; 362/241

[58] Field of Search ..... 362/147, 150, 252, 806, 362/807, 808, 235, 236, 237, 240, 241

[56] References Cited

U.S. PATENT DOCUMENTS

| | | | |
|---|---|---|---|
| 2,861,173 | 11/1958 | Nordquist | 362/150 |
| 3,145,493 | 8/1964 | Escalante | 362/252 |
| 3,244,870 | 4/1966 | Gallant | 362/252 |
| 3,714,409 | 1/1973 | Trudeau | 362/252 |
| 3,831,020 | 8/1974 | Paulson | 362/806 |
| 4,148,096 | 4/1979 | Haas | 362/252 |
| 4,164,008 | 8/1979 | Miller | 362/252 |
| 4,173,035 | 10/1979 | Hoyt | 362/252 |
| 4,357,653 | 11/1982 | Kovacs | 362/147 |
| 4,425,605 | 1/1984 | Cheng | 362/252 |
| 4,439,818 | 3/1984 | Scheib | 362/252 |
| 4,462,065 | 7/1984 | Rhodes | 362/252 |
| 4,480,293 | 10/1984 | Wells | 362/252 |

*Primary Examiner*—Ronald B. Cox

*Attorney, Agent, or Firm*—Wm. T. Wofford; James C. Fails; Arthur F. Zobal

[57] ABSTRACT

Improved lighting devices and systems made up of plurality of groups of miniature incandescent lamps, with lamps connected in series and groups connected in parallel, a lens for each lamp made of clear translucent material with double diffusion means, with lamps arranged in a predetermined array with respect to a reflecting surface which in most cases has the quality of specular reflection, and with a stated minimum light source density, as well as other aspects and features.

23 Claims, 18 Drawing Figures

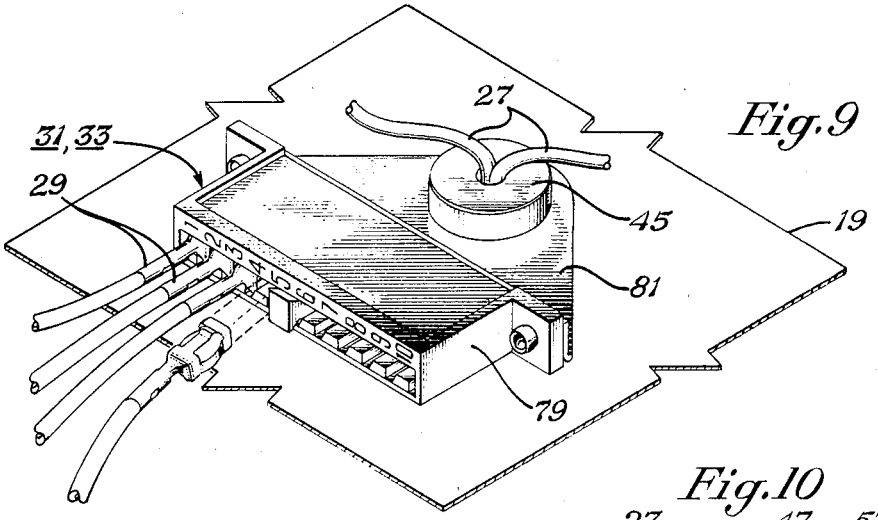
Fig.9
Fig.10
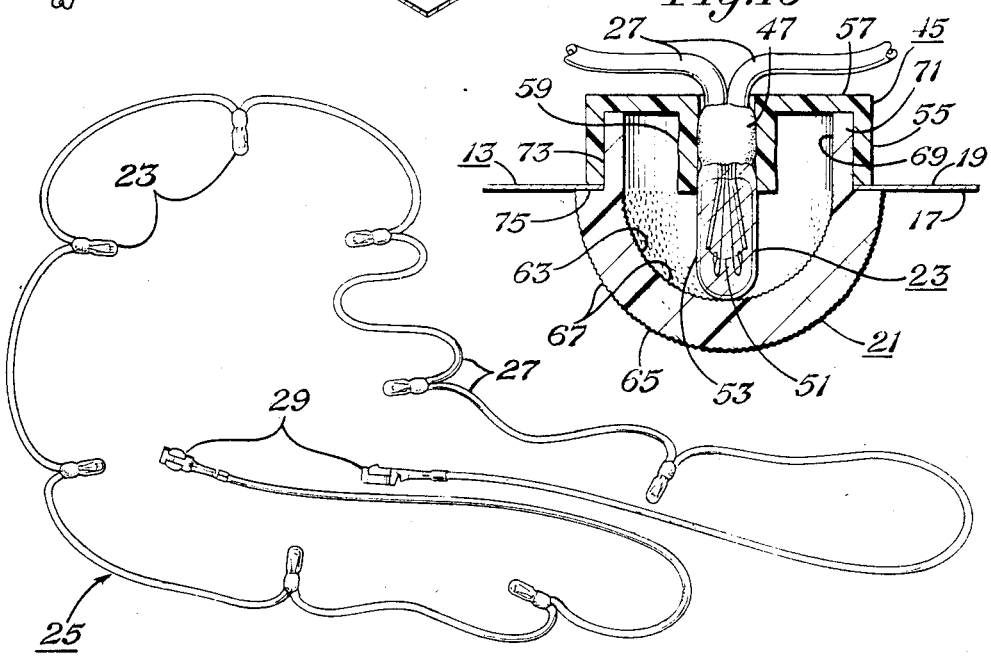
Fig.11
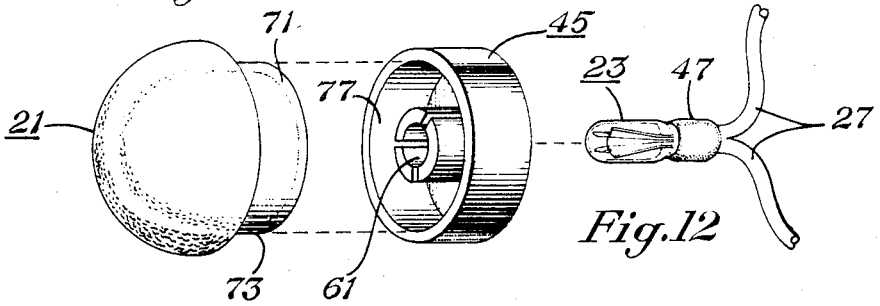
Fig.12

LIGHTING APPARATUS AND SYSTEM UTILIZING MINIATURE INCANDESCENT LAMPS

FIELD OF INVENTION

The present invention relates to lighting apparatus and systems utilizing miniature incandescent lamps and typically powered by alternating current from a commercial utility source.

BACKGROUND OF THE INVENTION

It is well known that there are a number of general types of lighting. The general types of lighting to which the present invention is applicable include task, normal, low level, guide or marker, decorative and display. These general types of lighting are defined for purposes herein as follows. Task lighting will provide light at a relatively high level such as would be required for close work, for example, secretarial work at a desk. Normal lighting will provide light at a level that is adequate and comfortable for activities that do not involve close work, for example, shopping in a retail outlet. Low level lighting will provide light at a level that is adequate and comfortable for moving about, for example, in hallways and stairwells. Guide or marker lighting will provide light sufficient for walkways in darkened areas, such as theatre aisles. Decorative lighting is lighting that is not primarily functional but serves to provide pleasing visual effects to an observer. Display lighting is lighting that is designed to enhance the appearance of objects such as merchandise to make them more attractive to look at; for example, glassware, metalware and automobiles.

The present invention, in the context of the prior art of which I am aware, provides lighting apparatus and systems utilizing miniature incandescent lamps which are improved and advantegeous in a number of ways as will hereinafter appear. Further, lighting apparatus of the present invention has versatility that makes it advantageously applicable to all of the types of lighting hereinabove mentioned.

BRIEF DESCRIPTION OF DRAWINGS

FIG. 9 is a fragmentary schematic perspective view showing details of electrical connections on the interior side of the outer pan of FIG. 3.

FIG. 10 is a schematic vertical section view showing a single lamp installed in a lighting panel outer pan of FIGS. 2, 3 or in an outer strip element of FIGS. 14–16.

FIG. 11 is a schematic view showing a single lamp group assembly.

FIG. 12 is an exploded schematic perspective view showing a single lens, lens cap member and lamp.

DESCRIPTION OF THE PREFERRED EMBODIMENTS

Figure 2:
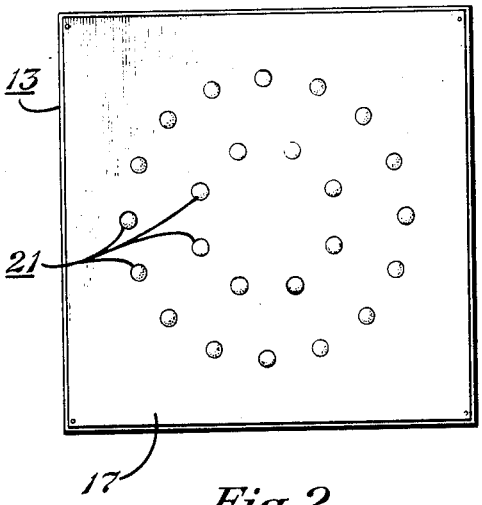
FIG. 2 is a schematic plan view of the exterior side of the outer pan with lamps installed, for one of the lighting panels of FIG. 1.
Figure 3:
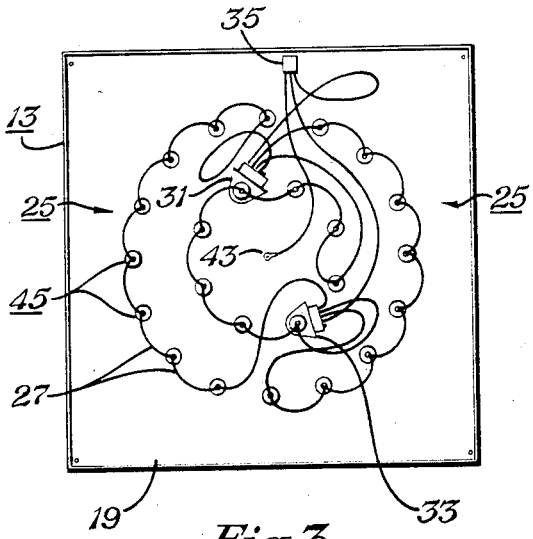
FIG. 3 is a schematic plan view of the interior side of the outer pan of FIG. 2 with lamps installed and wired.
Figure 4:
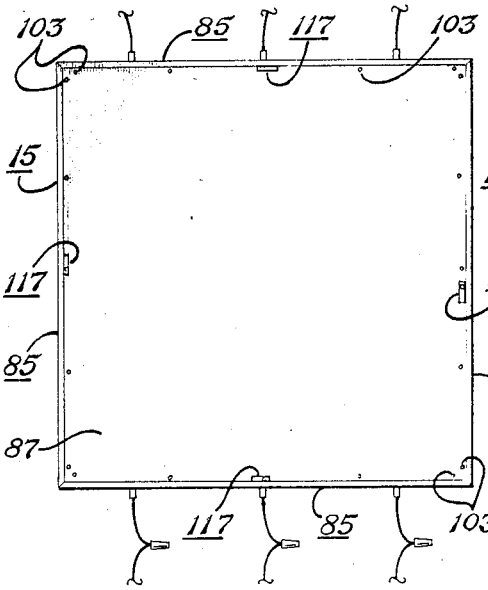
FIG. 4 is a schematic plan view of the exterior side of the inner pan, for one of the lighting panels of FIG. 1.
Figure 5:
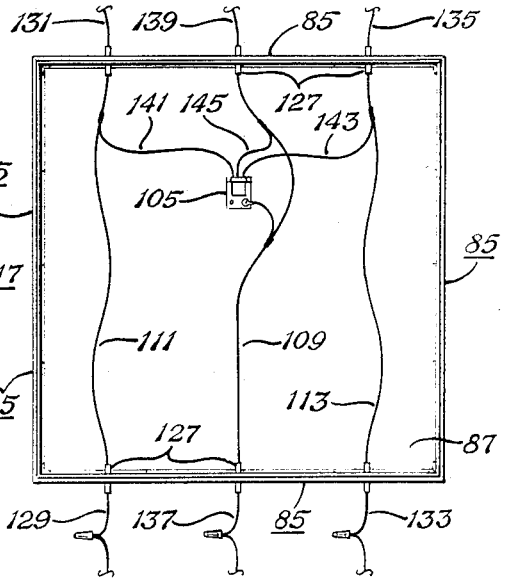
FIG. 5 is a schematic plan view of the interior side of the inner plan of FIG. 4.
Figure 6:
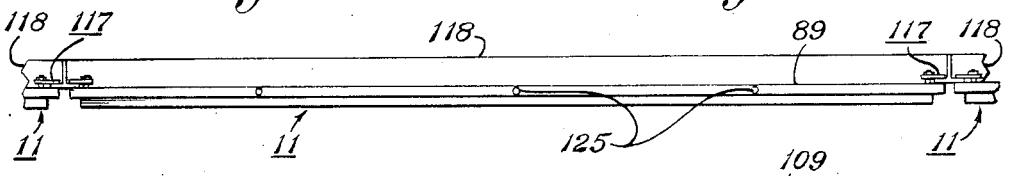
FIG. 6 is a schematic fragmentary side elevational view showing lighting panels of FIG. 1 installed on a T-bar grid.

A lighting panel in accordance with a preferred embodiment of the present invention will now be described. The lighting panel 11 includes an outer pan 13 as shown in FIGS. 2 and 3 and an inner pan 15 as shown in FIGS. 4 and 5. The outer pan 13 has an exterior side 17 as shown in FIG. 2 and an interior side 19 as shown in FIG. 3.

A plurality of groups of miniature incandescent lamps are disposed in a predetermined array with respect to the outer pan 13. In the embodiment shown, the array is symmetrical and is in the form of concentric circles, as is best shown by viewing the lenses 21 that protrude from the outer pan exterior side 17 in FIG. 2.

Figure 13:
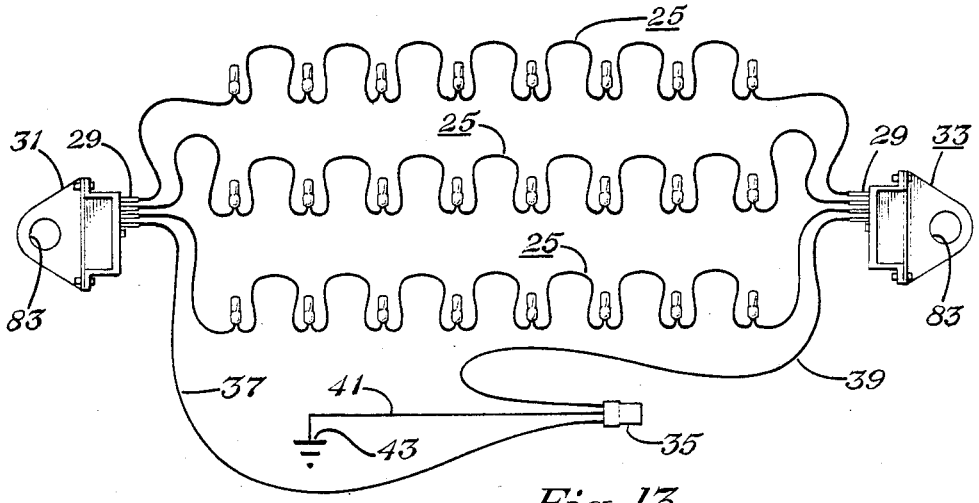
FIG. 13 is a schematic diagram showing a plurality of lamp group assemblies for a lighting panel and associated electrical connections.
Figure 14:
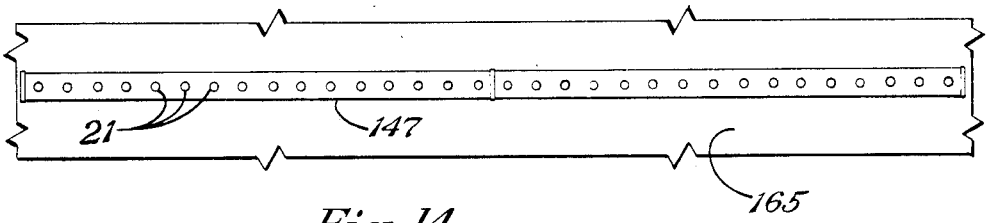
FIG. 14 is a schematic fragmentary plan view showing a plurality of strip lighting units installed in a strip lighting system in accordance with the invention.

A single group of miniature incandescent lamps is exemplified by FIG. 11 where there is shown a lamp group assembly 25 made up of eight miniature incandescent lamps 23 connected in series by means of suitable conductors 27, with terminal means 29 at each end of the group 25. The electrical connections for a plurality of lamp group assemblies 25 is best shown by FIG. 13. In the embodiment shown the lamp group assemblies 25 are connected in parallel by simply inserting the terminal means 29 at one end of the lamp group assembly 25 into a first connector receptacle 31 and inserting the terminal means 29 at the other end of the lamp group assembly 25 into a second connector receptacle 33. The lamp group assemblies 25 are adapted for connection to a normal source of alternating current power by means of a suitable outer pan connector plug 35 which has a first conductor 37 connected to said first connector receptacle 31, a second conductor 39 connected to said second connector receptacle 33 and a third conductor 41 connected to common or ground 43. The connector receptacles 31, 33 are the electrical equivalent of a common bus, so that all of the terminal means 29 that are inserted into a respective connector receptacle 31, 33 are connected together. There is, as is best shown by FIGS. 10 and 12, a lens 21 and a lens cap member 45 associated with each miniature incandescent lamp 23.

Each miniature incandescent lamp 23 has a base portion 47 to which a filament support structure 49 is secured, and within which supply conductors 27 are connected in series with a filament 51, and to which a filament envelope 53 is secured.

In the embodiment shown the lens cap member 45 has the form of a cylindrical cup of white deformable plastic material having a side wall 55 and an end wall 57, with the end wall 57 having a re-entrant portion 59 that is cylindrical. The re-entrant portion 59 has a bore 61 that is tapered radially inwardly in the direction away from the end wall 57. The re-entrant portion 59 further has a plurality of slots extending from its outer end toward the end wall 57. The function of the lens cap member re-entrant portion 59 is to receive and retain a respective miniature incandescent lamp 23, and it acts like a kind of chuck to effectively perform its function.

The lens 21 is made of clear translucent material and forms a cavity 63 for receiving a respective miniature incandescent lamp 23, with both the lens exterior 65 and the cavity 63 having diffusing surfaces 67. In the embodiment shown the surfaces of both the lens exterior 65 and the cavity 63 are spherical, and the lens exterior 65 is a hemisphere. The spherical surface portion of the lens cavity 63 merges with the inner wall 69 of a cylindrical portion 71, the exterior wall 73 of which merges with a shoulder portion 75 which lies in the plane containing the base of the lens exterior hemisphere. The exterior wall 73 of the cylindrical portion 71 is sized to matingly engage the interior surface 77 of the lens cap member side wall 55 with an interference fit so that the lens 21 is securely retained by the lens cap member 45 when assembled as shown in FIG. 10.

The outer pan 13 is provided with a circular opening for each lens 21. The circular opening is sized to matingly receive the lens cylindrical portion 71. To assemble the miniature incandescent lamps 23 with respect to the lighting panel outer pan 13, first a lens 21 and a lens cap member 45 are assembled at each said circular opening. A lens 21 is placed in the respective circular opening with the lens hemisphere 65 protruding outwardly from the outer pan exterior side 17, with the lens cylindrical portion 71 being matingly received by the circular opening and the lens shoulder portion 75 abutting the outer pan exterior side 17. Then the lens cap member side wall interior surface 77 is caused to matingly engage the lens cylindrical portion exterior wall 73 with an interference fit, with the end portion of the lens cap member side wall 55 abutting the interior side 19 of the outer pan 13. Thus the lens 21 and lens cap member 45 assembly is securely clamped to the outer pan 13.

At each of two convenient locations on the outer pan interior side 19, there is installed a first and a second connector receptacle 31, 33. As can best be seen in FIG. 9, each connector receptacle 31, 33 comprises a connector block portion 79 which is adapted for receiving terminal means 29, and an installation retainer tab 81. The installation retainer tab 81 is made of flat sheet material, preferably metal, and is secured to the connector block portion 79 by suitable means, such that the tab 81 and the connector block 79 inner sides are substantially coplanar. The installation retainer tab 81 is provided a circular opening 83 sized to matingly receive the lens cylindrical portion exterior wall 73. Thus the installation retainer tab 81 can be securely clamped to the outer pan 13 by means of the lens 21 and lens cap member 45.

After all of the lens and lens cap member assemblies are in place on the outer pan 13, the requisite number of lamp group assemblies 25 are installed. In the embodiment shown three lamp group assemblies 25 are required, as is best shown by FIG. 3. To install a lamp group assembly 25, the miniature incandescent lamps 23 of the assembly are each inserted into a respective lens cap member bore 61 and the terminal means 29 at each end of the lamp group assembly 25 is inserted into a respective first or second connector receptacle 31, 33. In each case the miniature incandescent lamp 23 is pressed into the lens cap member bore 61 until its filament envelope 53 bottoms out on the lens cavity 63. The chuck-like characteristics of the lens cap member reentrant portion 59 serve to securely retain the respective miniature incandescent lamp 23.

Figure 7:
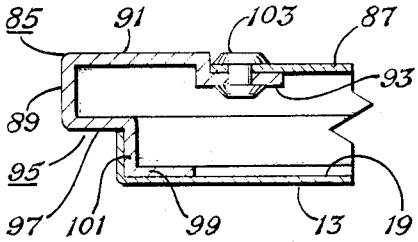
FIG. 7 is a schematic fragmentary vertical section view showing structure of an inner and outer pan assembly.

In the embodiment shown, the lighting panel inner pan 15 is made up of four side pieces 85 and a web portion 87. Each side piece 85 is preferably an extrusion, preferably of aluminum, having transverse section shape as shown by FIG. 7. Each side piece 85 has a perimeter wall portion 89 shown in FIG. 7 as being vertical, an upper face portion 91, a web support portion 93, and an outer pan support portion 95. The upper face portion 91 extends horizontally inwardly of the perimeter wall portion 89 and the web support portion 93 extends horizontally inwardly of the upper face portion 91 and is depressed relative to the upper surface of the face portion 91. The outer pan support portion extends inwardly of the perimeter wall portion 89 and is made up of upper and lower step portions 97, 99 joined by a riser portion 101. All portions of the side piece 85 are integral. The ends of the side pieces 85 are mitered so that four of them may be arranged with respective ends abutting to make up a rectangle, which in the embodiment shown is a square. The web portion 87 is rectangular and is sized to have its outer perimeter portion abut the web support portions 93, and is affixed to same by suitable fasteners such as rivets 103. The web support portions 93 are depressed sufficiently relative to the upper face portions 91 that the rivets 103 do not protrude beyond the upper surfaces of the upper face portions 91.

Electric power from a normal alternating current source is supplied to the lighting panel 11 via an input receptacle 105 which is fixed to the interior side of the inner pan web portion 87 by suitable means such as brads 107. Electrical connections to the input receptacle 105 consist of a common or ground conductor 109 and two line conductors 111, 113.

The lighting panel outer pan 13 has a peripheral wall portion 115. When the outer pan 13 is assembled onto the inner pan 15, the inner surface of the peripheral wall portion 115 is matingly received by the outer surface of the riser portion 101 of the outer pan support portion 95 of the inner pan 15. Also, when the outer pan 13 is assembled onto the inner pan 15, the peripheral portion of the interior side 19 of the outer pan 13 abuts the lower surface of the lower step portion 99 of the outer pan support portion 95 of the inner pan 15. The outer pan 13 is secured to the inner pan 15 by means of suitable fasteners, such as sheet metal screws (not shown).

The lighting panel 11 can be used singly, like a single lighting fixture, in which case the inner pan 15 is provided with conventional means (not shown) for mounting onto the usual ceiling wiring box. The lighting panel 11, however, is most effectively utilized in lighting systems wherein a plurality of lighting panels 11 are employed. In a lighting system, any requisite number of lighting panels 11 can be utilized. The lighting panels 11 can be juxtaposed so that a particular lighting panel has another lighting panel adjacent one of its sides, or lighting panels adjacent its opposite sides, or lighting panels adjacent all of its sides. Thus, any desired pattern of lighting panels can be employed.

Figure 18:
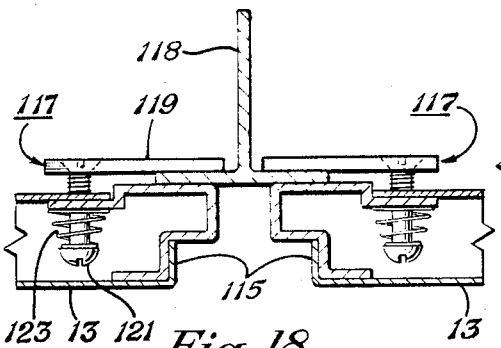
FIG. 18 is a schematic fragmentary vertical section view showing structure of juxtaposed inner and outer pan assemblies mounted to a T-bar.
Figure 8:
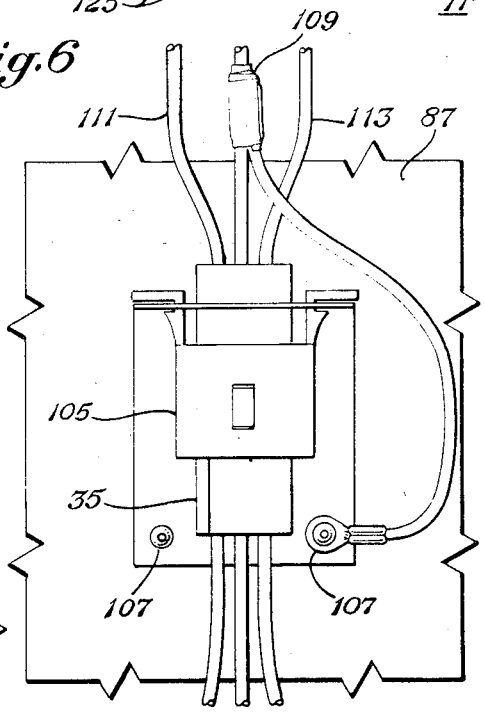
FIG. 8 is a fragmentary schematic plan view showing details of electrical connections on the interior side of the inner pan of FIG. 5.

One particularly advantageous way to install a lighting system utilizing lighting panels 11 is to mount the panels 11 in suspended fashion on a T-bar ceiling grid. T-bar ceiling grids are commonly used to support ceiling panels and fluorescent lighting fixtures. For T-bar mounting, the inner pan 15 of each lighting panel 11 is provided at the central portion of each of its sides a means 117 for clamping the peripheral portion of the inner pan exterior surface to a portion of the lower surface of the adjacent T-bars 118. In the embodiment shown the clamping means 117 (see FIG. 18) includes a clamping arm 119, a clamping arm support pin 121 and a bias spring 123. The clamping arm 119 may be a piece of metal strap material that is fixed to the end portion of the support pin 121 to extend transversely thereof. The support pin 121 is reciprocable in an opening in the web support portion 93 of the inner pan 15. The bias spring 123 bears at one end on the inner surface of the web support portion 93 and at the other end on the head portion of the support pin 121. The head portion of the support pin 121 incorporates a tool receiving means such as a screw slot.

To install a lighting panel 11 on a T-bar grid, the inner pan 15 is positioned so that the peripheral portion of its exterior surface (upper face portion 91 of inner pan side pieces 85) abuts a portion of the lower surface of adjacent T-bars 118. Next, for each clamping means 117, the support pin 121 is depressed and rotated so that the clamping arm 117 overlies the upper surface of the respective T-bar base portion and is then released. The result is that the lighting panel inner pan 15 is securely clamped to the adjacent T-bars 118.

After all of the inner pans 15 have been clamped to the T-bar grid, the alternating current power supply is connected. The perimeter wall portions 89 of each inner pan 15 are each provided with three spaced alignment and wiring conduit receiving openings 125. Wiring conduit and lighting panel aligning means, which in the embodiment shown is a cylindrical sleeve 127, preferably made of plastic material, is provided. A cylindrical sleeve 127 is inserted in and is matingly received by each of the adjacent openings 125 of adjacent inner pans 15, which results in proper alignment of the inner pans 15 and hence the lighting panels 11. Each inner pan is pre-wired, as best shown by FIG. 5, so that each line conductor 111, 113 and each ground conductor 109 includes respectively an input lead 129, 133, 137, an output lead 131, 135, 139 and an input receptacle lead 141, 143, 145. The input leads 129, 133, 137 and output leads 131, 135, 139 are adapted for connection to respective output leads and input leads of the respective adjacent inner pans 15 by suitable means, preferably wire nuts. The leads extending from one adjacent inner pan to another, of course, are passed through the cylindrical sleeves 127. Since the inner pans 15 are mounted in suspended fashion on the T-bar grid, the cylindrical sleeves 127, and hence the electrical conductors 129–139 are beneath the T-bar grid.

Figure 1:
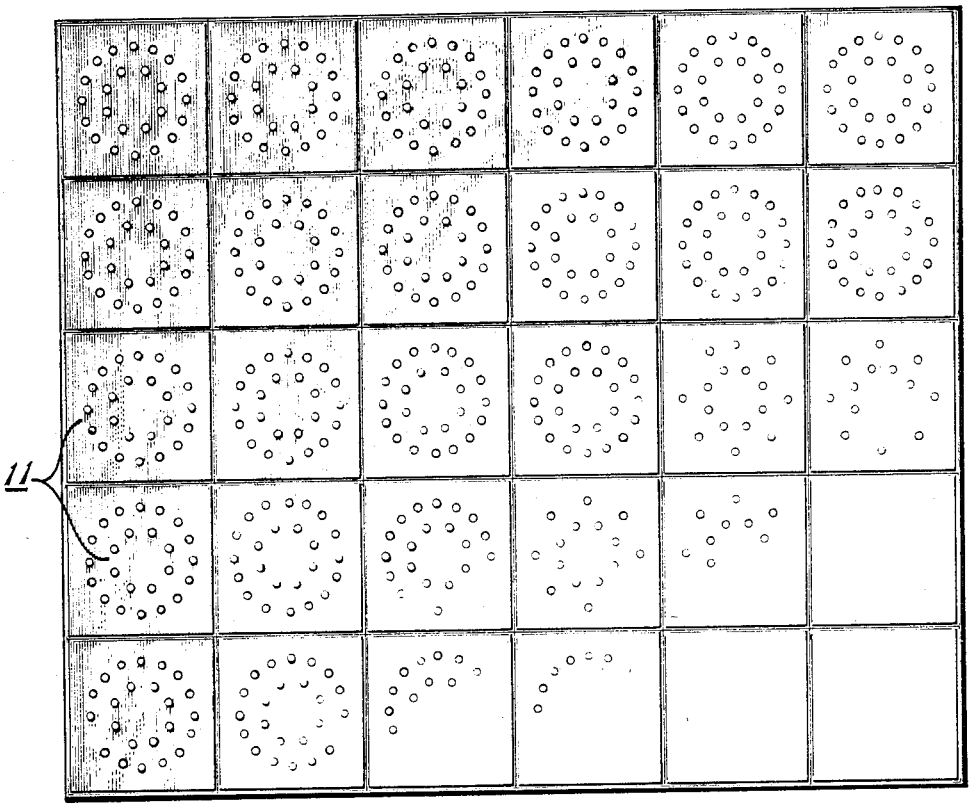
FIG. 1 is a schematic plan view showing a plurality of lighting panels installed in a lighting system in accordance with the invention.

The lighting system of FIG. 1 will be referred to as an example for explaining how the lighting panels 11 of a lighting system may be electrically interconnected. In FIG. 1 there is shown a lighting system made up of 30 lighting panels arranged in five rows with six lighting panels in each row. For reference the rows will be considered as numbered 1–5 from bottom to top in FIG. 1 and the panels will be considered as numbered 1–6 from left to right in FIG. 1. It should be noted that at this stage the outer pans 13 have not yet been installed, and references to connections between lighting panels 11 actually refer to connections between inner pans 15. The input leads 129, 133, 137 of row 1, panel 1 may be connected via a suitable opening (not shown) in the web portion 87 of the inner pan 15 to a normal source of alternating current power and the output leads 131, 135, 139 may be connected to the input leads of adjacent lighting panel 2 of row 1. Then the output leads of panel 2 row 1 will be connected to the input leads of panel 3, row 1, and so on until all of the lighting panels of row 1 are connected. Then the output leads of panel 6 of row 1 are connected to the input leads of panel 6 of row 2, the output leads of which are connected to panel 5 of row 2, and so on until all of the lighting panels of row 2 are connected. Then the output leads of panel 1 of row 2 are connected to the input leads of panel 1 of row 3, the output leads of which are connected to the input leads of panel 2 of row 3, and so on until all of the lighting panels of the lighting system have been connected.

When all of the lighting panels (inner pans 15) of the system have been connected, the respective outer pans 13 are installed by first connecting a respective outer pan connector plug 35 to a respective input receptacle 105 and then securing the outer pan to the inner pan in the manner hereinabove described.

The lamp group assemblies 25 of the present invention may also be utilized in strip lighting as shown by FIGS. 14–17. In the embodiment shown, the lighting strip is made up of a plurality of lamp carrier channels 147 arranged in end to end abutting relation. Each lamp carrier channel 147 has the form of an open ended "U" shaped trough having a bottom portion 149 and two side portions 151. Each lamp carrier channel 147 may conveniently be six feet long and have installed in it two lamp group assemblies 25 of eight lamps each. The bottom portion 149 of each lamp carrier channel 147 is provided with circular openings 153 for receiving the respective lens 21 and lens cap member 45. The circular openings 153 are on $4\frac{1}{2}$ inch centers with the centers of the end circular openings being $2\frac{1}{4}$ inches from the respective end of the lamp carrier channel 147. The lamp group assemblies 25 are installed with the respective lenses 21 and lens cap members 45 clamped at the circular openings 153 to the lamp carrier channel bottom portion in the same manner as hereinabove described regarding the outer pans 13 of the lighting panels 11.

The lamp carrier channels 147 are installed on suitable support means, which in the embodiment shown are inverted "U" shaped support channel members 155 each having a top portion 147 and two side portions 159. The support channel members 155 are sized such that their side portions 149 are matingly received within the side portions 151 of the respective lamp carrier channel 147. The side portions 151, 159 are provided with cooperating depressions 161 which act to secure the lamp carrier channels 147 to the support channel members 155.

Figure 17:
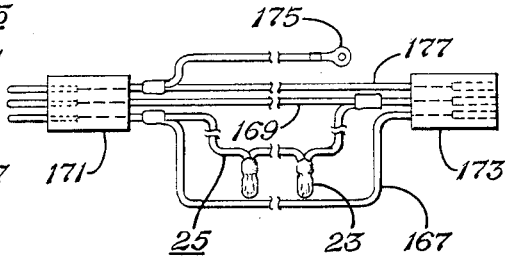
FIG. 17 is a schematic diagram showing electrical connections for the strip lighting system of FIGS. 14, 15.

The electrical connections for the lamp group assemblies 25 for use with strip lighting systems are shown by FIG. 17. Each lamp group assembly 25 is connected at one end to a first line conductor 167 and at the other end to a second line conductor 169. Each line conductor 167 is connected at one end to a respective input terminal of a male connector plug 171 and at the other end to a respective output terminal of a female connector plug 173. A ground or common terminal 175 is connected to a common conductor 177 which is connected at one end to a common input terminal of said male connector plug 171 and at the other end to a common output terminal of said female connector plug 173.

Figure 15:
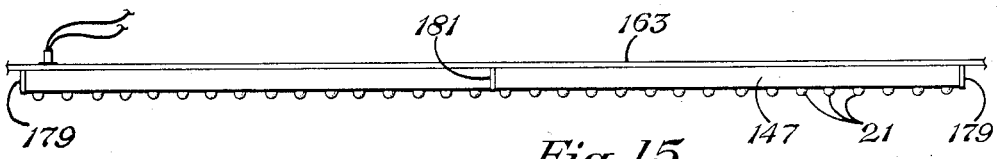
FIG. 15 is a schematic fragmentary side elevational view of the strip lighting system of FIG. 14.
Figure 16:
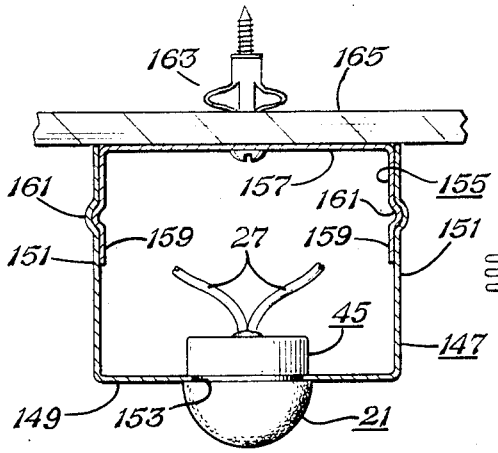
FIG. 16 is a schematic vertical section view of the strip lighting system of FIGS. 14, 15.

To install a strip lighting system, the requisite number of support channel members 155 are secured by suitable means 163 to a mounting structure 165 such as a ceiling, with the support channel members 155 being disposed in appropriate alignment. The lamp group assemblies 25 are installed in the lamp carrier channels 147 as hereinbefore mentioned. A first lamp carrier channel 147 is held by the installer near the location of the normal alternating current power source which is preferably at one end of the strip lighting system as indicated in FIG. 15. The normal alternating current power source is connected by suitable means to a female connector plug to which a male connector plug 171 can be connected. The installer will first connect the male connector plug 171 of the first lamp group assembly 25 to the female connector plug which has been connected to the power source. The male and female connector plugs 171, 173 of adjacent lamp group assemblies 25 which have been installed in a respective lamp carrier channel 147 will have been pre-connected. Next the installer will assemble the first lamp carrier channel 147 onto the appropriate support channel member or members 155. Next the installer will connect the male connector plug 171 of the second lamp carrier channel 147 to the female connector plug 173 of said first lamp carrier channel 147 and then assemble the second lamp carrier channel 147 onto the appropriate support channel member or members 155 with adjacent ends of the first and second lamp carrier channels 147 in abutting relation. The process is continued until all of the lamp carrier channels 147 of the strip lighting system have been connected and installed. Next suitable end caps 179 and joint covers 181 will be installed.

Further considerations concerning lighting systems of the present invention and their component parts will now be discussed.

The term "miniature incandescent lamp" as used herein means an incandescent lamp having very small physical dimensions, typically less than $\frac{3}{4}$ inches in length and less than $\frac{1}{4}$ inches in width, and being rated for power consumption of less than 1.5 watts when energized at rated voltage. In a preferred embodiment, the miniature incandescent lamps are size T $1\frac{3}{4}$. The diffusing surfaces herein referred to are of a type that will render the respective lamp filament essentially obscure without significantly interfering with the transmission of light through the respective lens. In a preferred embodiment, the lens diffusing surfaces are made up of numerous depressions, all of which have curved profile. Also in a preferred embodiment the respective lens surface that extends outwardly of the specular reflecting surface of the respective lighting panel outer pan is a hemisphere and the filament of a respective miniature incandescent lamp protrudes outwardly of the specular reflecting surface and into the lens cavity a distance that is at least one-half of the radius of the hemisphere. Further, in a preferred embodiment the lens hemisphere radius is 0.5 inches and the cavity radius is 0.3125 inches. Preferably the hemisphere radius will not in any case exceed 0.625 inches. The interior surface of the respective lens cap member, being of white plastic material, will act as a secondary reflector.

In a preferred embodiment, there are eight miniature incandescent lamps per lamp group assembly, with each lamp being designed to produce a voltage drop of about 14 volts when operated at a current flow that will cause its energy consumption to be substantially its rated wattage. Thus eight lamps is a suitable number when connected in series and energized to produce voltage drops the sum of which will be equal to or near equal to the normal alternating current source line voltage of around 115 volts. More lamps or fewer lamps per group could be used provided that the sum of their voltage drops when they are operated within their ratings is equal to or near equal to normal alternating current source line voltage and further provided that the minimum number is four. However, eight lamps per lamp group assembly is considered to be an optimum number.

In a preferred embodiment, the lighting panels are square and have three lamp group assemblies arranged in two concentric circles, with eight lamps in the inner circle and 16 lamps in the outer circle. However, a light panel, particularly if it is to be used as a single light fixture, may have any desired number of lamp group assemblies, for example, as many as eight. Not only may the number of lamp group assemblies per lighting panel be any desired number, but both the lamp pattern and the lighting panel peripheral shape may be varied. The lamp pattern, for example, could be rows in a rectangular pattern, concentric figures such as rectangles, triangles, ovals, etc. The lighting panel peripheral shape can be square, rectangular, regular polygonal, parallelogram, etc. In every case, however, the light source density should be a minimum of four lamps per square foot of lighting panel exterior surface. Also in every case the lighting panel exterior surface should have the quality of specular reflection. It is possible to obtain sheet metal material incorporating an exterior surface having the quality of specular reflection, and in a preferred embodiment the lighting panel outer pan is made of such material.

The lighting panels herein disclosed may be used singly as individual lighting fixtures as hereinabove mentioned, or in various groups and group patterns or arrangements to make up a lighting system, depending upon the application and the effects desired. One arrangement is to have rows of several lighting panels each, with the respective lighting panels being juxtaposed, to make up a rectangular field, as shown by FIG. 1. Such arrangement is well adapted for task lighting when a relatively large number of lighting panels are used in a relatively large space. The lamps of the same arrangement can be dimmed to a level that will provide normal lighting. The lamps of the same arrangement can also be used for a decorative lighting effect and for display lighting. Another lighting panel arrangement would be to have a single row of lighting panels, or several rows with space between each row. Lighting panels could be arranged as the perimeter of a rectangle with space inside, or in the form of a plus sign, or an "X". The numbers and types of possible lighting panel arrangements is unlimited.

The lighting panels and systems herein disclosed have some important characteristics. The filaments of the numerous miniature incandescent lamps of a lighting system are essentially obscured so that the dazzling bright spot effect that would otherwise be present is eliminated. This is accomplished without significantly interfering with the transmission of light through the lenses. The light emanating from each lens is thoroughly diffused, and is emitted in all directions radially of the lens hemisphere, but the filament placement within the lens cavity produces the greatest light intensity within a cone that contains approximately the lower half of the lens hemisphere, with light intensity diminishing in the direction toward the specular reflecting surface. The lower light intensity in the direction toward the specular reflecting surface is well compensated by the light emanating from the other lamps that are present in the lighting panel and lighting panels, and the light reflected by the specular reflecting surfaces. The overall effect is a remarkably uniform light distribution throughout the lighted space. This effect tends to give the observer the feeling of a pleasant ambience. This effect also greatly enhances the appearance of objects being displayed, such as glassware, metalware and automobiles.

The wiring of the lighting systems herein disclosed is simple, economical and effective. A lighting system will need to be connected to a normal source of alternating current power at only one lighting panel location and the rest of the system is connected by simply respectively connecting the two line conductors and common conductors of adjacent inner pans using wire nuts and the outer pan connector plug into the inner pan input receptacle. The spaces between the inner and outer pans of the lighting panels serve as the wireway for all of the needed electrical connections.

The headroom required by the lighting panels and systems herein disclosed is negligible, with a typical lighting panel thickness being only 0.625 inches, and with the lenses protruding 0.5 inches outwardly of the lighting panel specular reflecting surface, for an overall thickness of only 1.125 inches.

It is apparent from the foregoing that the lighting panels and systems herein disclosed have a high degree of versatility in that they can be effectively utilized for all of task, normal, low level, decorative and display types of lighting in a wide variety of forms and applications.

The strip lighting systems herein disclosed have the same attributes as the lighting panel systems, with some exceptions and variations. The same miniature incandescent lamps, lenses and lens cap members are used in both cases. The lamp group assemblies are also the same except for the end connections. The wiring of all lamp group assemblies in parallel is also the same except that the wiring means in the strip lighting case is designed to extend longitudinally of the strip. Strip lighting systems can also be used for all of task, normal, low level, decorative and display types of lighting as well as for guide or marker lighting. The strip lighting systems, however are best suited for low level lighting, particularly hallways, passageways and stairwells, and for guide or marker lighting. When the strip lighting systems are used for low level lighting or marker lighting it is not essential that the exterior surface of the lamp carrier channel bottom portion should have the quality of specular reflection, and may instead be simply white paint.

The foregoing disclosure and the showings made in the drawings are merely illustrative of the principles of this invention and are not to be interpreted in a limiting sense.

I claim:

1. A lighting panel comprising:

a. a plurality of groups of miniature incandescent lamps, with each said group being made up of at least four lamps, with means connecting the lamps of each group in series, with means connecting said groups in parallel, with means adapted for connecting said groups to a normal source of alternating current power, with each said lamp being rated for consumption of less than 1.5 watts when energized, with the sum of the voltage drops of the lamps of a group when operating at normal rated wattage being substantially equal to the voltage of said power source;

b. an exterior surface having the quality of specular reflection, with the filament of each said lamp being disposed outwardly of said exterior surface, with said lamps being arranged in a predetermined array with respect to said exterior surface and such that the light source density is a minimum of four lamps per square foot of said exterior surface;

c. a lens for each said lamp, with each said lens being made of clear translucent material and forming a cavity for receiving the respective lamp, with both the lens exterior and the cavity having diffusing surfaces, and with said lens exterior diffusing surface protruding outwardly of said panel exterior surface.

2. The lighting panel of claim 1 wherein said exterior surface is substantially planar, said predetermined array of lamps is a symmetrical pattern, said lens exterior and lens cavity surfaces are spherical, said lens exterior diffusing surface is a hemisphere having a radius, with a said respective lamp filament protruding outwardly of said lighting panel exterior surface a distance that is at least one half of said radius.

3. The lighting panel of claim 2 wherein said lens exterior diffusing surface radius does not exceed 0.625 inches and said symmetrical pattern is in the form of concentric circles.

4. The lighting panel of claim 2 wherein said lens diffusing surfaces are made up of numerous depressions, all of which have curved profile.

5. The lighting panel of claim 3 wherein said lens diffusing surfaces are made up of numerous depressions, all of which have curved profile.

6. The lighting panel of claim 1 wherein there is provided an inner pan structure having interior and exterior surfaces and adapted for mounting on an installation structure and an outer pan structure having interior and exterior surfaces and adapted for mounting to said inner pan structure, with wiring means for said lamps and positioning and retaining means for said lamps being disposed between said interior surfaces of said pan structures.

7. The lighting panel of claim 2 wherein there is provided an inner pan structure having interior and exterior surfaces and adapted for mounting on an installation structure and an outer pan structure having interior and exterior surfaces and adapted for mounting to said inner pan structure, with wiring means for said lamps and positioning and retaining means for said lamps being disposed between said interior surfaces of said pan structures.

8. The lighting panel of claim 3 wherein there is provided an inner pan structure having interior and exterior surfaces and adapted for mounting on an installation structure and an outer pan structure having interior and exterior surfaces and adapted for mounting to said inner pan structure, with wiring means for said lamps and positioning and retaining means for said lamps being disposed between said interior surfaces of said pan structures.

9. The lighting panel of claim 4 wherein there is provided an inner pan structure having interior and exterior surfaces and adapted for mounting on an installation structure and an outer pan structure having interior and exterior surfaces and adapted for mounting to said inner pan structure, with wiring means for said lamps and positioning and retaining means for said lamps being disposed between said interior surfaces of said pan structures.

10. A lighting system made up of a plurality of lighting panels in accordance with any one of claims 1–9.

11. A lighting system made up of a plurality of lighting panels in accordance with any one of claims 6–9 and wherein said lighting panels are juxtaposed, with said inner pan having sidewalls, with wiring conduit and lighting panel alignment means communicating between adjacent said sidewalls for accomodating electrical wiring between adjacent lighting panels and aligning said panels.

12. A lighting system made up of a plurality of lighting panels in accordance with any one of claims 6–9 and wherein said lighting panels are juxtaposed, with said inner pan having sidewalls, with wiring conduit and lighting panel alignment means communicating between adjacent said sidewalls for accomodating electrical wiring between adjacent lighting panels and aligning said panels and with said inner pan incorporating means for mounting a said respective lighting panel in suspended fashion on a T-bar ceiling grid.

13. A lighting system made up of a plurality of lighting panels in accordance with any one of claims 6–9 and wherein said lighting panels are juxtaposed, with said inner pan having sidewalls, with wiring conduit and lighting panel alignment means communicating between adjacent said sidewalls for accomodating electrical wiring between adjacent lighting panels and aligning said panels and with said inner pan incorporating means for mounting a said respective lighting panel on a T-bar ceiling grid, said mounting means including means for clamping the peripheral portion of said inner pan exterior surface to a portion of the lower surface of the adjacent T-bars.

14. A lighting device comprising:

a. a plurality of groups of miniature incandescent lamps, with each said group being made up of at least four lamps, with means connecting the lamps of each group in series, with means connecting said groups in parallel, with means adapted for connecting said groups to a normal source of alternating current power, with each said lamp being rated for consumption of less than 1.5 watts when energized, with the sum of the voltage drops of the lamps of a group when operating at normal rated wattage being substantially equal to the voltage of said power source;

b. an exterior reflecting surface with the filament of each said lamp being disposed outwardly of said exterior surface, with said lamps being arranged in a predetermined array with respect to said exterior surface;

c. a lens for each said lamp, with each said lens being made of clear translucent material and forming a cavity for receiving the respective lamp, with both the lens exterior and the cavity having diffusing surfaces, and with said lens exterior diffusing surface protruding outwardly of said lighting device exterior surface.

15. The lighting device of claim 14 wherein said exterior surface is substantially planar, said lens exterior and lens cavity surfaces are spherical, said lens exterior diffusing surface is a hemisphere having a radius, with a said respective lamp filament protruding outwardly of said lighting device exterior surface a distance that is at least one half of said radius.

16. The lighting panel of claim 15 wherein said lens exterior diffusing surface radius does not exceed 0.625 inches.

17. The lighting device of claim 15 wherein said lens diffusing surfaces are made up of numerous depressions, all of which have curved profile.

18. The lighting device of claim 16 wherein said lens diffusing surfaces are made up of numerous depressions all of which have curved profile.

19. A lighting strip comprising:

a. a plurality of groups of miniature incandescent lamps, with each said group being made up of at least four lamps, with means connecting the lamps of each group in series, with means connecting said groups in parallel, with means adapted for connecting said groups to a normal source of alternating current power, with each said lamp being rated for consumption of less than 1.5 watts when energized, with the sum of the voltage drops of the lamps of a group when operating at normal rated wattage being substantially equal to the voltage of said power source;

b. an exterior reflecting surface with the filament of each said lamp being disposed outwardly of said exterior surface, with said lamps being arranged in a predetermined array with respect to said exterior surface and such that the light source density is a minimum of two lamps per linear foot of said exterior surface;

c. a lens for each said lamp, with each said lens being made of clear translucent material and forming a cavity for receiving the respective lamp, with both the lens exterior and the cavity having diffusing surfaces, and with said lens exterior diffusing surface protruding outwardly of said lighting strip exterior surface.

20. The lighting strip of claim 19 wherein said exterior surface is substantially planar, said lens exterior and lens cavity surfaces are spherical, said lens exterior diffusing surface is a hemisphere having a radius, with a said respective lamp filament protruding outwardly of said lighting strip exterior surface a distance that is at least one half of said radius.

21. The lighting strip of claim 20 wherein said lens exterior diffusing surface radius does not exceed 0.625 inches.

22. The lighting strip of claim 20 wherein said lens diffusing surfaces are made up of numerous depressions, all of which have curved profile.

23. The lighting strip of claim 21 wherein said lens diffusing surfaces are made up of numerous depressions all of which have curved profile.

* * * * *